United States Patent [19]

Mainiero

[11] Patent Number: 4,920,775

[45] Date of Patent: May 1, 1990

[54] APPARATUS FOR MAKING BARBED TAPE

[75] Inventor: John W. Mainiero, Sandy Hook, Conn.

[73] Assignee: MRM Security Systems, Inc., Waterbury, Conn.

[21] Appl. No.: 400,485

[22] Filed: Aug. 30, 1989

Related U.S. Application Data

[62] Division of Ser. No. 317,642, Mar. 1, 1989, Pat. No. 4,884,425, which is a division of Ser. No. 236,652, Aug. 25, 1988, Pat. No. 4,833,904, which is a division of Ser. No. 876,715, Jun. 20, 1986, Pat. No. 4,784,373.

[51] Int. Cl.[5] ..... B21C 51/00; B21F 25/00

[52] U.S. Cl. ..... 72/10; 72/37; 72/184; 72/187; 72/190; 140/58; 29/7.1

[58] Field of Search ..... 72/190, 184, 185, 187, 72/12, 37, 10; 140/58, 66, 69; 29/7.1, 7.2

[56] References Cited

U.S. PATENT DOCUMENTS

| | | | |
|---|---|---|---|
| 99,329 | 2/1870 | Levake | 72/136 |
| 254,904 | 3/1882 | Bate | 29/7.1 |
| 302,534 | 7/1884 | Jordan | 29/7.1 |
| 389,590 | 9/1888 | Miles | 140/66 |
| 2,446,891 | 8/1948 | Tower et al. | 72/167 |
| 2,948,049 | 8/1960 | Wilson | 140/58 |
| 3,228,219 | 1/1966 | Fox | 72/243 |
| 3,457,756 | 7/1969 | Rohde | 72/187 |
| 3,491,562 | 1/1970 | Kajiwara | 72/12 |
| 3,638,463 | 2/1972 | Cala | 72/12 |
| 4,328,955 | 5/1982 | Hermans | 140/58 |
| 4,735,116 | 4/1988 | Ginzburg | 72/194 |
| 4,759,205 | 7/1988 | Kuwano et al. | 72/37 |

FOREIGN PATENT DOCUMENTS

| | | | |
|---|---|---|---|
| 992363 | 10/1951 | France | 72/167 |
| 59-166325 | 9/1984 | Japan | 72/167 |
| 59-189019 | 10/1984 | Japan | 72/167 |
| 235001 | 10/1986 | Japan | 72/190 |

*Primary Examiner*—Daniel C. Crane

*Attorney, Agent, or Firm*—Anthony J. Casella; Gerald E. Hespos

[57] ABSTRACT

An apparatus and process is provided for forming a helical barbed tape. The process first involves supplying rolled steel which is passed to an apparatus for blanking barbs and cutting the steel into strips. The strips are mounted on individual cassettes. The tape subsequently is fed from a cassette to a barb sensor and barb setter. The barb setter moves with the tape to effect the required offset in response to the sensed presence of a barb cluster. The tape then advances to a roll former which exerts a controlled differential pressure on opposed sides of the tape to create a uniform circular coil. The tape will have an unequal thickness across its width with the differential thickness being substantially uniform along the length of the tape.

4 Claims, 5 Drawing Sheets

APPARATUS FOR MAKING BARBED TAPE

This application is a divisional of U.S. patent application Ser. No. 317,642 filed Mar. 1, 1989, now U.S. Pat. No. 4,884,425, issued Dec. 5, 1989; which is a divisional of U.S. patent application Ser. No. 236,652 filed Aug. 25, 1988, now U.S. Pat. No. 4,833,904 dated May 30, 1989 for "PROCESS FOR MAKING BARBED TAPE"; and which in turn is a divisional of U.S. patent application Ser. No. 876,715 filed June 20, 1986, now U.S. Pat. No. 4,784,373 dated Nov. 15, 1988 for "BARBED TAPE".

BACKGROUND OF THE INVENTION

Helical barbed tape is used to create a substantially impenetrable barrier in locations where security is an important factor. The helical barbed tape is defined by an elongated helix or coil wherein the plane of the tape is aligned generally perpendicular to the axis of the helix. Flat barbs extend angularly outward from opposed sides of the tape and are angularly offset from the plane of the tape.

Helical barbed tape has become a widely accepted form of security at many military installations and prisons. One or more elongated coils of the barbed tape may be stretched across an open area to define a barrier. Alternatively, one or more coils of the barbed tape may be stretched adjacent to the base of a fence or wall to prevent a person from scaling the structure. In many situations a coil of the barbed tape may be mounted to the top of a fence or wall. This latter application has been used extensively in nonmilitary and non-institutional use. For example, many storage yards and warehouses are surrounded by chain link fences having a continuous strand of helical barbed tape mounted to the top. The helical barbed tape may be employed in single coils or in mutliple coils. In one known form, a small coil may be concentrically mounted within a larger coil with the respective helices being generated in opposite directions.

A relevant example of a helical barbed tape is shown in U.S. Pat. No. 3,463,455 which issued to P. T. Meckel on Aug. 26, 1969. U.S. Pat. No. 3,463,455 indicates that the barbed tape unit may define a true helix of generally circular configuration, or alternatively may define a generally eliptical or polygonal coil. The disclosure of U.S. Pat. No. 3,463,455 does not define the manufacturing technique by which the generally helical configuration is achieved. However, it is believed that the art as developed at the time U.S. Pat. No. 3,463,455 issued employed an apparatus that repeatedly hammered into one side of the tape to gradually deform the tape into the generally helical configuration disclosed in U.S. Pat. No. 3,463,455. This prior art manufacturing technique created substantial stresses on both the manufacturing machine and on the barbed tape. As a result, damage to both the tape and to the machine was likely. This process also was quite slow and required substantial quality control testing to ensure that a substantially uniform coil was being developed.

An apparatus and method for forming barbed tape is shown in U.S. Pat. No. 4,028,925 which issued to Michael R. Mainiero on June 14, 1977. The method disclosed in U.S. Pat. No. 4,028,925 involved mechanically clamping adjacent sections of a flat straight metallic strip and edge bending the adjacent sections relative to one another a controlled angular amount such that the adjacent sections remain substantially in their initial flat plane. The method and apparatus disclosed in U.S. Pat. No. 4,028,925 only is capable of forming a generally polygonal coil, and is not capable of forming a true helix with circular coils.

The barbed tape that is acceptable for military applications is defined in U.S. Specification No. Mil-B-52775. This specification defines the acceptable materials and dimensions and depicts both the circular and polygonal configurations of the helix. Mil-B-52775 does not define a method of manufacture. This specification has effectively become the standard for many nonmilitary applications of barbed tape.

Virtually all applications of helical barbed tape, including those manufactured to the standards of Mil-B-52775, employ a stainless steel tape formed into a polygonal coiled configuration. This configuration has been generally universally accepted because of the relative ease of forming the polygonal structure and the relative difficulty of reliably forming a uniform circular helical structure.

Despite its wide acceptance, the polygonal barbed tape has several disadvantages. The most severe disadvantage concerns the structural effects of placing the bends in the tape to define the corners of the polygon. More particularly, the bends of necessity form crimps or ripples adjacent the radially inside edge of the tape. Conversely, the radially outermost edge of the tape is stretched through the bend at a point directly opposite the crimp or ripple. The inherent brittleness of the hard stainless steel tape creates a substantial probability of cracking along the radially outermost edge of the tape at the point of the bend. These cracks will be aligned in a generally radial direction. In view of this tendency to crack, the barbed tape must be subjected to extensive quality control which adds to the manufacturing costs. In many instances, these cracks will be very small and will not be readily visible to the unaided human eye. In fact, some cracks will not extend entirely through the metal out will merely be formed in one or both opposed surfaces of the tape adjacent the outer edge of the bend. Although these small cracks may be initially inconsequential, they can have severe implications after the tape has been put into use. More particularly, the barbed tape will inevitably vibrate in response to wind and other ambient conditions. These vibrations will cause the microscopic cracks to propagate. After a relatively short period of time, the initially microscopic crack can extend completely across the tape. These breaks in the tape effectively prevent the tape from fulfilling its security function.

In addition to the potential for cracks, the bends may also sever the protective coatings put on certain metallic materials. By severing this protective layer, a more vulnerable interior layer of metallic material may be exposed to the actions of the environment.

Another deficiency of the polygonal barbed tape coils is that the polygonal structure inherently must be formed as part of an intermittent action. The repeated stopping and starting of the machine and the tape passing therethrough is slow and creates substantial wear on the various parts being alternately accelerated and decelerated.

Certain barbed tapes have been developed into a circular configuration by forming the central part of the barbed tape around a core wire. The core wire will thus support the tape and the tape will move with the wire. The wire can thus be formed into a circular helical coil with the tape conforming to the circular helical configuration of the wire. This structure is shown, for example, in U.S. Pat. No. 2,908,484 which issued to Uhl on Oct. 13, 1959. The combination of the barbed tape with the core wire also has several significant disadvantages. For example, the presence of the core wire adds significantly to the weight and cost of the structure. Furthermore, the presence of the core wire prevents the compact collapsing which is possible with the flat barbed tape. Thus, this type of barbed tape requires substantially more storage area, which can be of critical importance in many military applications where a large amount of tape must be transported under demanding conditions to a distant location for prompt deployment. Another disadvantage results from the additional structural support caused by the core wire. More particularly, the stronger barbed tape product having a core wire disposed therein will not be as likely to collapse upon an intruder attempting to pass therethrough.

In view of the above, it is an object of the subject invention to provide a process for producing a substantially circular flat barbed tape.

It is an additional object of the subject invention to provide an apparatus for producing a substantially circular flat barbed tape.

Another object of the subject invention is to provide an apparatus for continuously producing a helical barbed tape.

Still another object of the subject invention is to provide a flat helical barbed tape of substantially uniform cross section along its length.

An additional object of the subject invention is to provide a helical barbed tape substantially free of cracks adjacent the radially outer edge thereof.

SUMMARY OF THE INVENTION

The subject invention is directed to a process for forming a substantially circular barbed tape. The process comprises the first step of supplying a roll of steel which is a selected multiple of times wider than the intended width of the barbed tape. The process next includes the step of cutting the roll of steel into strips and simultaneously blanking the barbs on each strip. This cutting and blanking operation will be carried out such that the barbs of one tape will be blanked from a portion of the rolled steel that is disposed intermediate the barbs of the adjacent tape. The strips with the barbs blanked therein will then be rolled onto separate cassettes. More particularly, each cassette will be mounted at a different elevational position than the cassette on either side of it. As a result, alternate strips of tape will advance from the blanking and cutting apparatus at different angular alignments. Consequently, adjacent tapes can be rolled onto their respective cassettes without interfering with the adjacent tape and cassette. The cassettes preferably will be disposed either at a first or a second elevation, such that each tape wound onto a cassette at the first elevation will be adjacent tapes being wound onto cassettes at the second elevation. As the cassettes are filled, they will advance to a cassette storage location from which they may be drawn upon as needed.

The filled cassettes with the barbs blanked therein will then be advanced, as needed, to a tape feeder. The tapes will be advanced from the tape feeder through a barb sensor which will sense the precise location of each barb. The sensed presence of a barb will trigger a barb setter mounted in a controlled spaced relationship to the barb sensor. The barb setter will be operative to angularly offset the barbs relative to their initial plane. To avoid an intermittent movement of the tape, the barb setter will be movably disposed relative to a frame and will be operative to advance at the same speed as the tape so as to provide no relative movement therebetween. After the barb has been properly set, the barb setter will return to its initial position for activation in response to the next set of barbs sensed by the barb sensor.

The tape then will advance through a roll former. The roll former is operative to exert a carefully controlled but differential pressure on opposite sides of the tape. As a result, the side of the tape receiving the greater pressure will be thinned a controlled amount. This thinning of the tape will cause the tape to assume a coiled configuration. The diameter of the coil will be a function of the relative pressure on the opposed sides of the coil. The required differential pressure can be determined with considerable accuracy based upon the metallurgical characteristics of the material from which the tape is formed. However, to ensure the necessary accuracy, the process further comprises the step of sensing the degree of curvature of the tape advancing from the roll former. Variations from the preferred degree of curvature can be sensed by a controller. The controller will then communicate with the pressure means to effect minor changes to the differential pressure in order to ensure an accurate degree of curvature. The coil will advance from the coil sensor into a horizontal storage cassette such that the axis of the helix will be generally vertically aligned. This storage alignment facilitates the handling of the tape prior to the complete filling of the cassette.

The resulting helical barbed tape is substantially devoid of bends and is of uniform cross-sectional configuration along its entire length. This uniform cross section will define a lesser thickness along the radially outer edge of the tape. As a result, the barbed tape will be free the microscopic cracks that had caused problems with the prior art barbed tape. Furthermore, the roll forming will perform an annealing function that will strengthen the tape.

DETAILED DESCRIPTION OF THE PREFERRED EMBODIMENT

Figure 1:
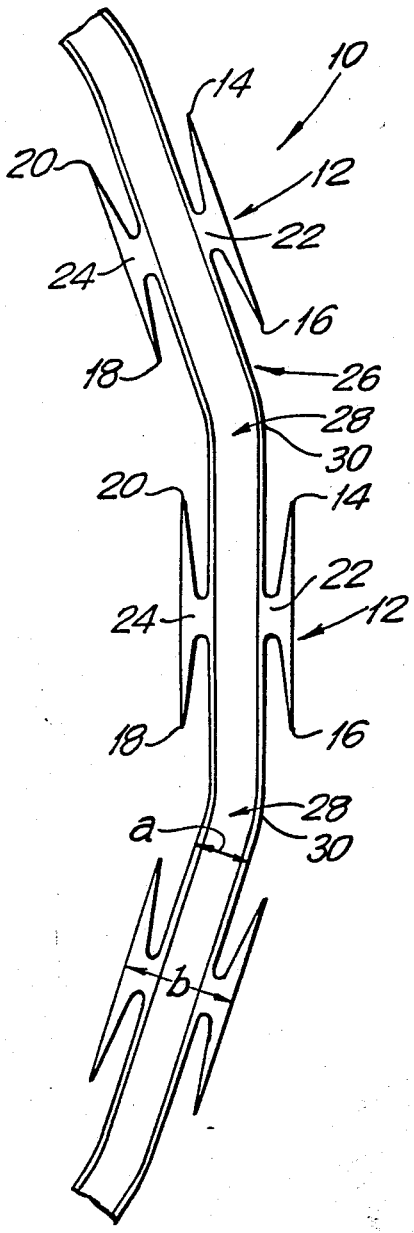
(PRIOR ART) FIG. 1
FIG. 1 is a top elevational view of a section of a prior art barbed tape.
Figure 2:
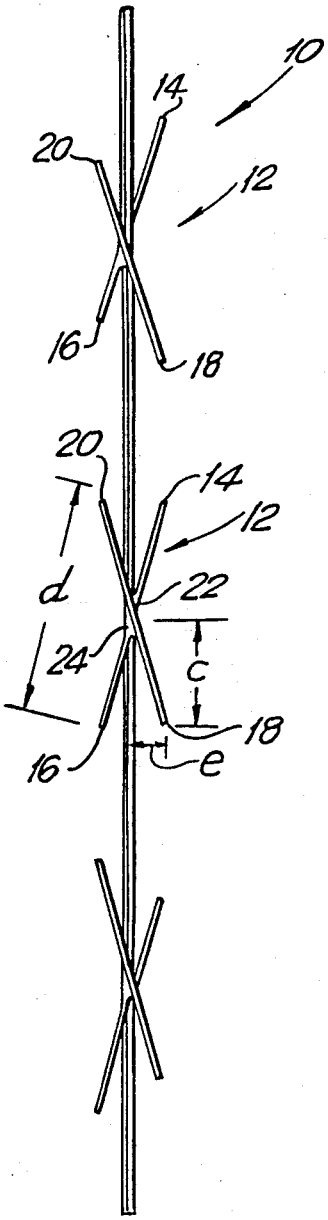
(PRIOR ART) FIG. 2
FIG. 2 is a side elevational view of the section of barbed tape shown in FIG. 1.

The barbed tape of the prior art is shown in FIGS. 1 and 2 and is indicated generally by the numeral 10. The barbed tape 10 includes a plurality of spaced apart barb clusters 12, with each barb cluster 12 consisting of four sharply pointed barbs 14–20. More particularly, barbs 14 and 16 extend from a common root 22 and are disposed upon the radially outward side of the barbed tape 10. Similarly, the barbs 18 and 20 extend from a common root 24 and are disposed on the radially inward side of the barbed tape 10. A central supporting portion 26 extends between the opposing roots 22 and 24 and between adjacent clusters of barbs 12. As shown most clearly in FIG. 2, the barbs 14–20 are offset relative to the central tape portion 26. More particularly, barbs 14 and 18 are offset in a first direction relative to the central tape portion 26, while the barbs 16 and 20 are offset in a second direction.

Various dimensional relationships of the structural elements shown in FIGS. 1 and 2 are possible. However, U.S. Specification No. Mil-B-52775 recommends that the central tape portion 26 have a width "a" of between 0.55 and 0.65 inches. The total recommended width at a barbed cluster 22 is recommended between 1.19 and 1.23 inches, as indicated by dimension "b." The recommended length for each barb as measured parallel to the plane of the central tape portion 26 is between 1.00 and 1.40 inches as indicated by dimension "c" in FIG. 2, while the overall length of a pair of barbs, as indicated by dimension "d" is recommended to be between 2.00 and 2.80 inches. An offset of 0.15 to 0.45 inches for the barbs 14–20 is recommended, as indicated by dimension "e." The preferred material for the manufacture of the barbed tape 10 is either austenitic stainless steel or carbon steel.

The barbed tape typically is formed into a coil having an inside diameter of approximately 18 inches, 24 inches or 30 inches. The coiled configuration generally is developed by forming a plurality of bends 28 in a previously straight section of coil to define a polygon. The polygon typically will have between 12 and 24 sides per loop. The bend points 28 are formed substantially midway between adjacent barb clusters 12.

While the prior art barbed tape 10 has performed well in most applications, there has been a tendency for small cracks to develop at the radially outermost portion 30 of each bend 28. The cracks at locations 30 have developed because of the substantial elongation stresses created at locations 30 as a result of the bends 28. In many instances, the cracks at location 30 will be only microscopic in size. However, vibrations caused by wind and other factors will result in crack propagation wherein the original microscopic cracks will grow in size substantially, and may ultimately cause a complete failure of the barbed tape 10.

Figure 3:
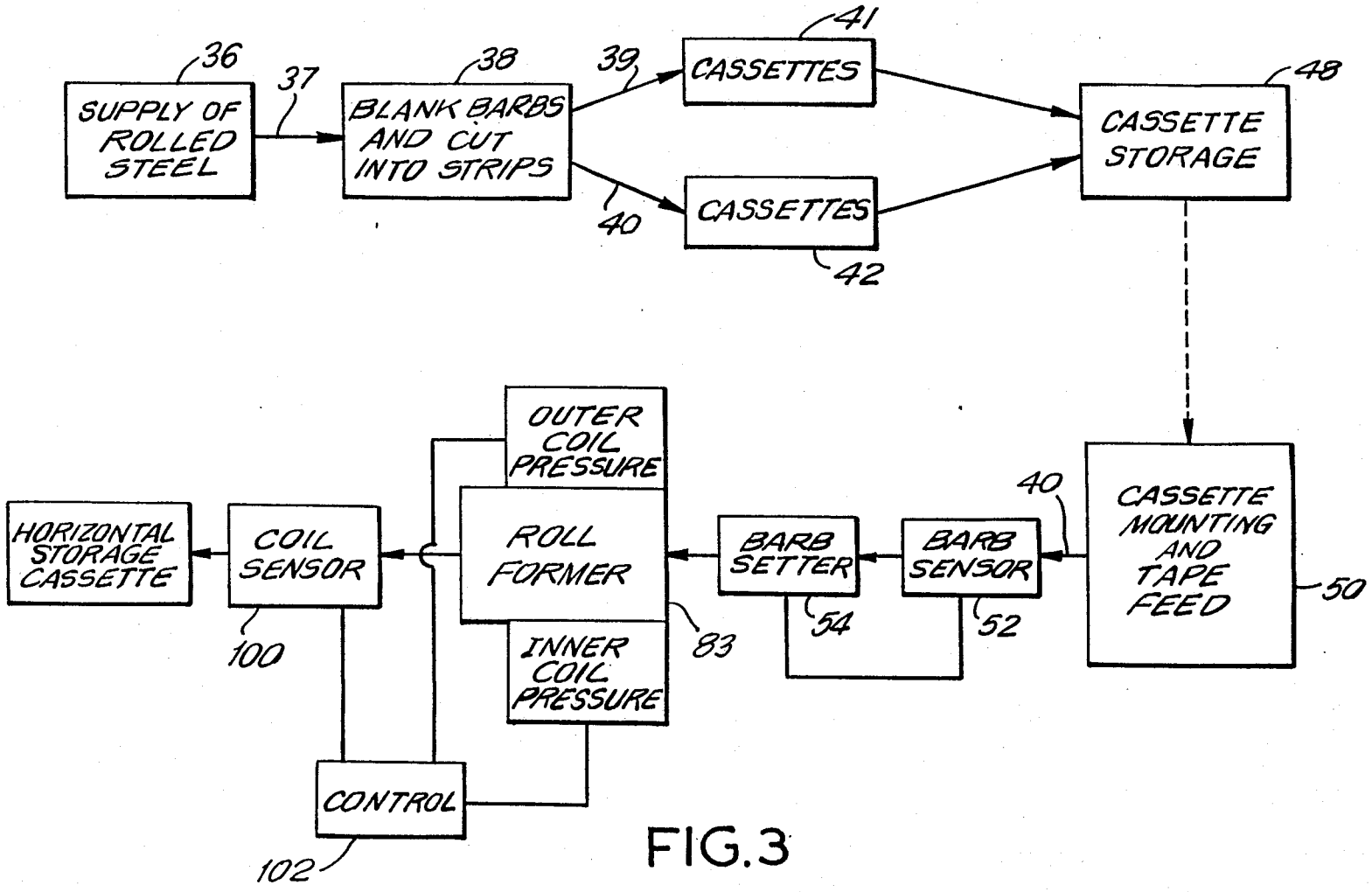
FIG. 3 is a schematic flow diagram of the process of the subject invention.

The subject invention avoids the problems of the prior art barbed tape 10 by manufacturing barbed tape in accordance with the process indicated schematically in FIG. 3. The process shown in FIG. 3 involves the first step of providing a supply of rolled steel indicated generally by the numeral 36 in FIG. 3. The rolled steel typically will have a width equal to some multiple of the overall width of the barbed tape to be produced by this process. The steel is rolled from the supply 36 to an apparatus 38 for blanking the barbs and simultaneously cutting the steel into strips of the required width. The blanking and cutting apparatus is operative to blank the barbs such that the barb cluster of one strip is intermediate the barb clusters on the strips adjacent thereto. Thus, the barbs of one strip will lie substantially adjacent the central tape portion of the strips adjacent thereto. It is preferred that the steel from supply 36 be wide enough to be cut into eight strips by the apparatus 38. As an alternate embodiment, the rolled steel 36 may be wide enough to yield twelve strips in a simultaneous blanking and cutting operation by apparatus 38.

The plurality of strips of steel 39, 40 with the barbs blanked therein are then advanced to a plurality of first cassettes 41 and a plurality of second cassettes 42. The cassettes 41 and 42 have substantially parallel rotational axes but are disposed at different locations such that the barbed tape 39 advancing to one of the cassettes 41 leaves the apparatus 38 at a first angle, while the barbed tape 40 advancing to one of the cassettes 42 leaves the apparatus 38 at a second angle. The cassettes 41 and 42 are disposed such that adjacent strips 39 and 40 will advance respectively to a first cassette 41 and a second cassette 42. Thus, even though the barbs of tape 39 are nested intermediate the barbs of tape 40, the subject method enables these closely nested tapes 39 and 40 to be separated and simultaneously wound onto their own respective cassettes 41 and 42.

It should be emphasized that at this point in the process, the tapes 39 and 40 are coiled such that their respective planes lie substantially parallel to the rotational axes of the cassettes 41 and 42. This is in contrast to the finished barbed tape coil wherein the plane of the tape lies substantially perpendicular to the longitudinal axis of the coil. As the cassettes 41 and 42 are filled, they are advanced to a cassette storage location 48 from which they will be drawn upon as needed to be formed into the barbed tape coil.

Figure 4:
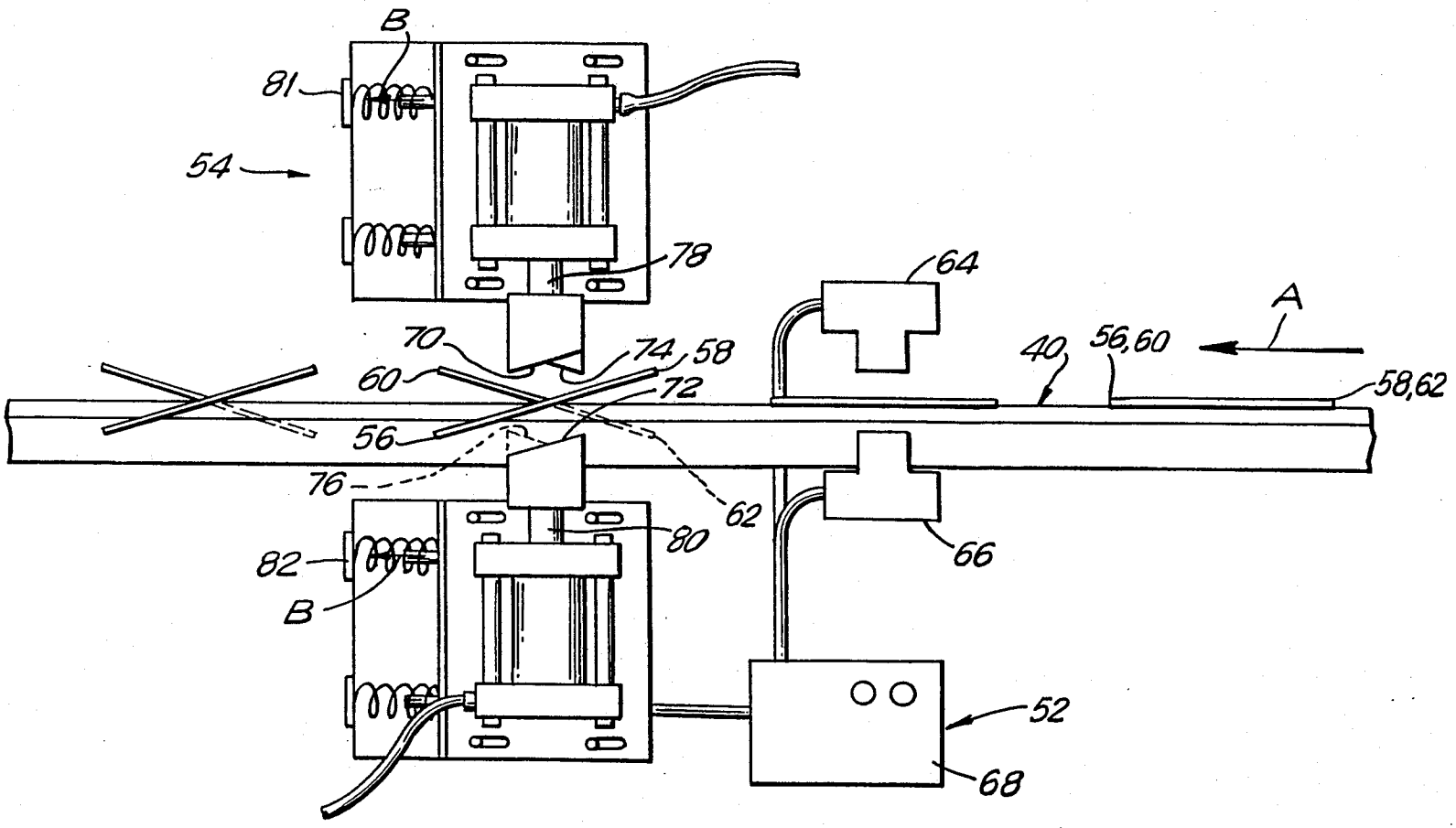
FIG. 4 is a side elevational view of the barb setter of the subject invention.

The cassettes 41 or 42 are sequentially drawn from the cassette storage 44 and are placed in the cassette mounting and tape feed apparatus 50. The tape 40 then is wound from apparatus 50 and advances to a barb sensor 52 and a barb setter 54, both of which are shown in greater detail in FIG. 4. As illustrated in FIG. 4, the tape 40 advancing toward the barb sensor 52 and barb setter 54 is provided with previously blanked barbs 56–62 which are disposed such that barbs 56 and 58 extend from a common root and are on one side of tape 40, while barbs 60 and 62 extended from a root on the opposite side of tape 40. The barb sensor 52 comprises a light source 64, a photoelectric cell 66 and a processing unit 68. The light source 64 and the photoelectric cell 66 are aligned with one another and are aligned with the barbs 56 and 58 on one longitudinal side of the tape 40. As a result, as the tape 40 moves between the light source 64 and the photoelectric cell 66, the presence of the barbs 56 and 58 will temporarily block the passage of light between the source 64 and the photoelectric cell 66. This temporary blockage of the light sensed by the photoelectric cell 66 will cause the processing unit 68 to send a signal to the barb setter 54.

The barb setter 54 comprises dies 70–76. More particularly, dies 70 and 72 are substantially parallel to one another and are in line with the barbs 56 and 58 of tape 40. Similarly, dies 74 and 76 are aligned with one another and with the barbs 60 and 62 of tape 40. The dies 70 and 74 are disposed to one side of the plane of tape 40 and are mounted to a piston 78 which is operative to move the dies 70 and 74 toward the tape 40. Similarly, the dies 72 and 76 are disposed to the opposite side of the plane of tape 40 and are mounted to piston 80 which is operative to move dies 72 and 76 toward the tape 40.

Both the distance between the barb sensor 52 and the barb setter 54 and the speed of the tape 40 moving relative thereto are known. As a result, the amount of time required for a set of barbs 56–62 to pass from the barb sensor 52 to the barb setter 54 also is precisely known. Using this known time, the processing unit 68 will send a signal to the barb setter 54 causing the pistons 78 and 80 to be activated when the barbs 56–62 are properly aligned relative to dies 70–76. The movement of the dies 70 and 74 toward to dies 72 and 76 will cause the barbs 56–62 to be offset as shown in FIG. 4. However, the tape 40 will be moving in the direction indicated by arrow "A" while the dies 70 and 74 are moving toward dies 72 and 76. Therefore, to ensure proper alignment, the dies 70–76 will also move with the tape 40 as indicated by arrows "B." More particularly, the dies 70–76 will move at the same speed as the tape 40. Consequently, the dies 70–76 will remain properly aligned with the barbs 56–62 until the angular setting of the barbs 56–62 has been achieved and the dies 70–76 have been completely withdrawn. The dies 70–76 and their respective pistons 78 and 80 will then return to their initial position relative to the barb sensor 52. The movement of the pistons 78 and 80 in direction "B" may be effected by hydraulic or pneumatic fluid or by an electric motor. The return of piston 78 and 80 to the positions shown in FIG. 4 is effected by springs 81 and 82.

For high speed operations, the barb setter may comprise a plurality of sets of barb setting dies at spaced apart locations along the tape 40. With this configuration, a given set of dies 70–76 will not be required to offset all of the barbs on the tape 40. For example, if two sets of dies 70–76 are employed, each set will be required to offset only every second set of barbs. Similarly, if three sets of dies 70–76 are employed, each set will be required only to offset every third set of barbs 56–62. With this embodiment, however, the range of movement for each set of dies 70–76 will be the same as for a single set of dies. Therefore, each set of dies 70–76 will be given a greater amount of time to return to its initial position.

Figure 5:
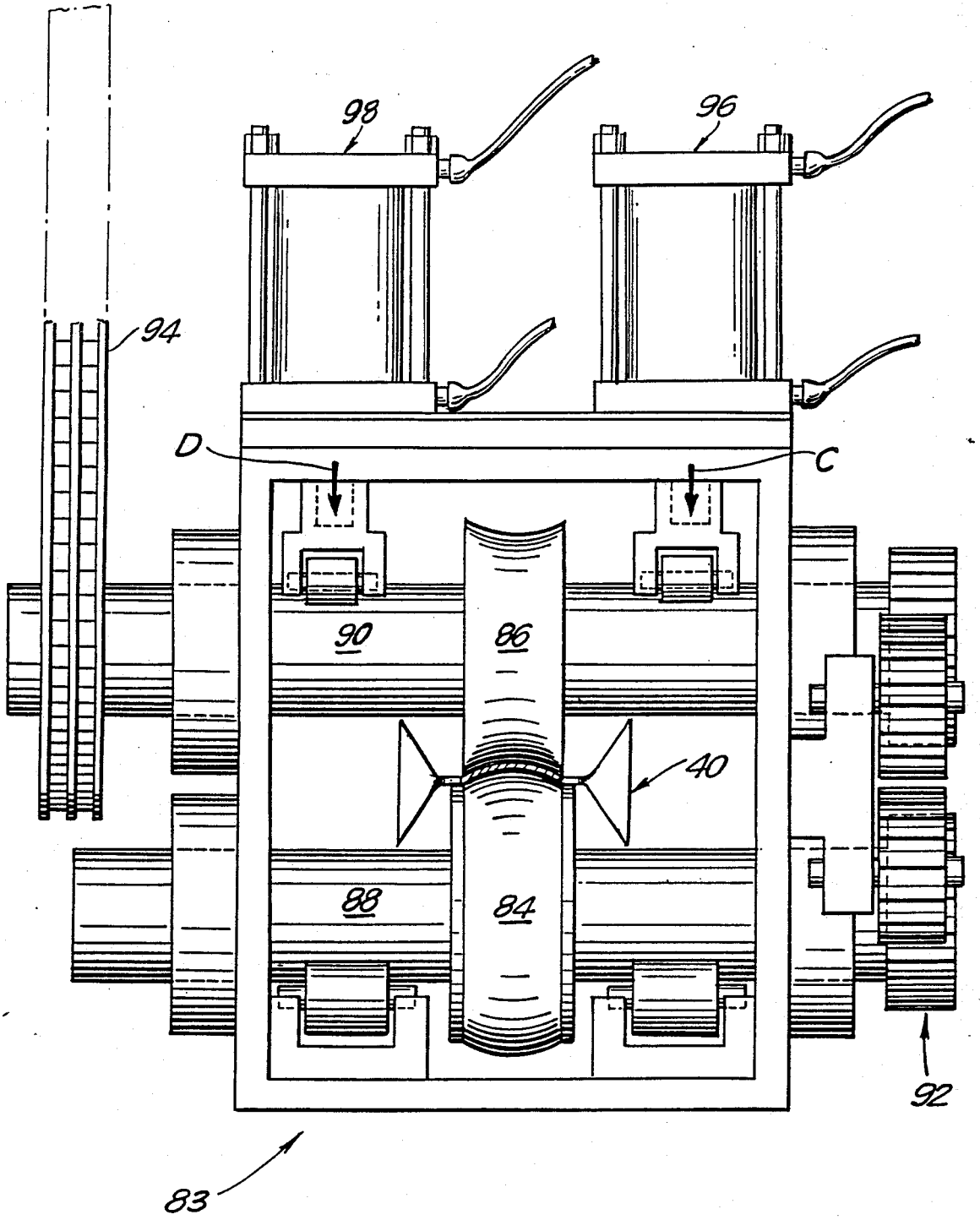
FIG. 5 is a front elevational view of the coil former of the subject invention.
Figure 6:
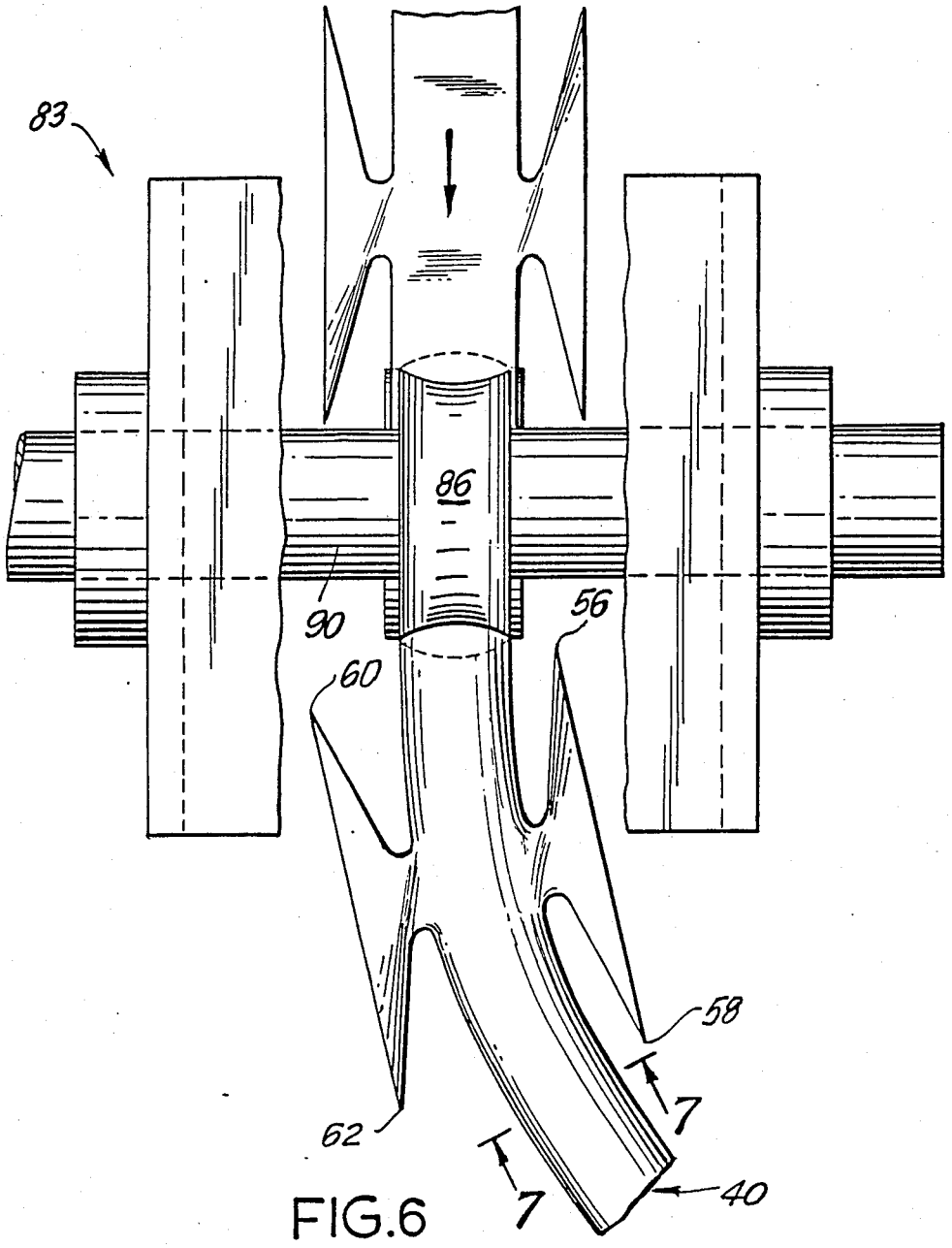
FIG. 6 is a top cross-sectional view of the coil former of the subject invention.

The tape 40 with the barbs 56–62 properly offset then is advanced to the roll former 83 which is shown generally in FIG. 3 and in greater detail in FIGS. 5 and 6. The roll former 83 is operative to create a cross-sectional arch along the length of tape 40 as permitted by the above recited United States specifications. This arch is achieved by passing the tape 40 between a convex roller 84 and a concave roller 86. The convex roller 84 is mounted to drive shaft 88, while the concave roller 86 is mounted to drive shaft 90. The drive shafts 88 and 90 are driven through gears 92 and drive means 94.

Figure 7:
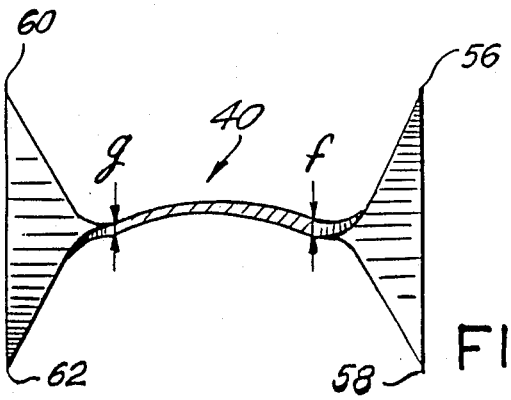
FIG. 7 is a cross-sectional view taken along line 7—7 in FIG. 6.

The roll former 83 also is provided with inner and outer piston means 96 and 98 which are operative to create differential downward pressures "C" and "D." More particularly, piston 96 will generate a force that is a selected amount less than the force generated by piston 98. As a result of these differential forces, the concave forming wheel 86 will exert a greater force on one side of tape 40 than on the other side. These differential forces will cause one longitudinal side of tape 40 to be thinned a controlled amount relative to the opposite longitudinal side thereof. This thinning will be uniform along the entire length of tape 40 and will cause tape 40 to assume a circular helical configuration. This dimensional change is illustrated most clearly in FIG. 7 which shows that the thickness "f" of the tape passing from the side of rollers 84 and 86 nearest piston 96 will be greater than the thickness "g" of tape 40 passing from the side of rollers 84 and 86 nearest piston 98. This method of forming the circular helix in tape 40 is continuous rather than intermittent and virtually precludes the formation of cracks. Furthermore, the pressure exerted by rollers 84 and 86 performs an annealing function which strengthens tape 40.

The differential thicknesses "f" and "g" and the resulting coiling effect, can be controlled by knowing the metallurgical characteristics of tape 40 and the relative pressures exerted by pistons 96 and 98. However, the metallurgical characteristics and the dimensions of the tape 40 passing into the roll former 83 may not be precise along the entire length of tape 40. As a result, as shown in FIG. 3, a coil sensor 100 is provided at a controlled distance from the roll former 83. The coil sensor 100 preferably comprises an array of light sources and an array of photoelectric cells which are operative to sense the radius of curvature of the tape 40 passing from the roll former 83. Any minor differences from the preferred radius of curvature will be sensed by the coil sensor 100. The process further comprises a control unit 102 which is in communication with both the coil sensor 100 and the roll former 83. The control unit 102 will assess the actual radius of curvature as sensed by the coil sensor 100 and compare that actual value to the specified radius of curvature. The control unit 102 will then make fine adjustments to the pressure generated by pistons 96 and 98 to overcome any minor variations in the radius of curvature.

The barbed tape advancing from the roll former 83 and coil sensor 100 will have the plane of the tape substantially perpendicular to the axis of the formed coil. This coil will be gravitationally fed into a horizontal storage cassette with the successive coils being neatly nested on top of one another. As the tape is completed, the horizontal storage cassette will be sealed and appropriately packed for shipment to the consumer. Alternatively, the filled horizontal cassette may advance to a location where the tape therein can be used to make a double coil product comprising two oppositely directed helices with a small helix disposed centrally with a large helix. In still other embodiments, the coiled tape could be wrapped around a coiled supporting wire prior to be fed into the cassette.

In summary, the invention is directed to a method and apparatus for forming a helical barbed tape with substantially uniformly dimensioned circular coils throughout. The process involves the first step of providing a supply of rolled steel having a width equal to some multiple of the required width for each strip of barbed tape. The rolled steel is advanced to an apparatus where the barbs are blanked and the various strips are cut. This step of the process is carried out such that the barbs of one strip are nested intermediate the barbs of an adjacent strip. Alternate strips then are directed to either first cassettes or second cassettes such that the strips going to any of the first cassettes leave the barb blanking and cutting apparatus at a first angle while the strips advancing to any of the second cassettes leave at a different angle. The cassettes of tape with the barbs blanked therein are then sequentially mounted onto a tape feeding apparatus. The tape is rolled from the cassette at a controlled speed and passes a barb sensor and barb setter. The barb setter responds to the sensed presence of a barb cluster and places the required offset into the barbs. To enable the continuous movement of the tape during this barb setting operation, the barb setter dies move with the tape during the barb setting operation. The tape then is advanced to a roll former which creates a cross sectional arch in the tape and which applies differential pressures to the opposed sides of the tape. The differential pressures are controlled to create a uniform thinning along one side of the tape relative to the other side. As a result, the tape will acquire a uniform circular helical configuration. The radius of this helix will be sensed by a coil sensor which will enable minor adjustments to the respective pressures for achieving the optimum accuracy of the radius of curvature. The coiled tape will then advance into a horizontal storage cassette for packaging and shipment to the consumer or for other manufacturing steps, such as the formation of a double coil product.

While the invention has been described relative to certain preferred embodiments, it is apparent that various changes can be made without departing from the scope of the invention as defined by the appended claims.

WHAT IS CLAIMED IS:

1. An apparatus for offsetting the barbs of a continuously moving strip of barbed tape, said tape defining an elongated generally planar metallic tape having a central tape portion and clusters of barbs at spaced apart locations along said central tape portion, each said cluster of barbs defining a pair of oppositely directed barbs on one side of said tape portion and a second pair of oppositely directed barbs along the opposed side of said tape portion, said apparatus comprising:

barb sensor means for sensing the presence of a cluster of barbs on the tape moving relative thereto;

barb setter means operatively connected to said barb sensor means for offsetting the barbs relative to the plane of said tape in response to the sensed presence of a barb cluster; and means for moving the barb setter means parallel to the direction of movement of the tape while simultaneously offsetting the barbs with the barb setter means.

2. An apparatus as in claim 1 wherein the barb sensor means comprises a light source and a light sensor disposed to sense at least a portion of a barb cluster moving relative thereto.

3. An apparatus as in claim 2 wherein the barb setter means comprises a first pair of barb setter dies disposed on one side of the plane of said barbed tape and a second pair of barb setter dies disposed on the opposite side of the plane of said barbed tape and in alignment with the first pair of barb setter dies, said barb setter means further comprising a plurality of pistons for moving the respective barb setter dies toward the barbs of said tape.

4. An apparatus as in claim 1 wherein the means for moving the barb setter means parallel to the direction of movement of the tape is operative to move the barb setter means from a first position to a second position and then to move the barb setter means from the second position to the first position.

* * * * *